US006393773B1

(12) United States Patent
Marks

(10) Patent No.: US 6,393,773 B1
(45) Date of Patent: May 28, 2002

(54) END CAP FOR CONCRETE BALCONY AND METHOD THEREFOR

(76) Inventor: Lawrence M. Marks, 3840 Kent Ct., Coconut Grove, FL (US) 33133

( * ) Notice: Subject to any disclaimer, the term of this patent is extended or adjusted under 35 U.S.C. 154(b) by 0 days.

(21) Appl. No.: 09/518,042

(22) Filed: Mar. 2, 2000

Related U.S. Application Data

(60) Provisional application No. 60/170,498, filed on Dec. 13, 1999.

(51) Int. Cl.[7] ..... E02D 37/00; E04G 23/00

(52) U.S. Cl. ..... 52/73; 52/97; 52/58; 52/716.2; 52/800.11; 52/287.1

(58) Field of Search ..... 52/73, 58, 94, 52/96, 249, 97, 177, 287.1, 716.2, 254, 255, 256, 800.11

(56) References Cited

U.S. PATENT DOCUMENTS

| | | | | |
|---|---|---|---|---|
| 1,019,951 A | * | 3/1912 | Congill | |
| 1,536,895 A | | 5/1925 | Lindyberg | |
| 3,132,445 A | * | 5/1964 | Swanson | |
| 3,243,926 A | | 4/1966 | Keyt | 52/94 |
| 4,012,878 A | * | 3/1977 | Ellingson | |
| 4,313,991 A | * | 2/1982 | Lamb | |
| 4,624,087 A | * | 11/1986 | Schneller | |
| 4,700,512 A | | 10/1987 | Laska | 52/58 |
| 4,780,021 A | | 10/1988 | Bettigole | 404/72 |
| 4,869,752 A | | 9/1989 | Jaklin | 106/14.21 |
| 4,869,753 A | | 9/1989 | Jaklin | 106/74 |
| 5,131,198 A | * | 7/1992 | Ritchie et al. | |
| 5,170,597 A | * | 12/1992 | Stearns | |
| 5,436,048 A | * | 7/1995 | Meier et al. | |
| 5,505,030 A | | 4/1996 | Michalcewiz et al. | 52/249 |
| 5,546,719 A | * | 8/1996 | Maiers et al. | |
| 5,729,933 A | | 3/1998 | Strength | 52/96 |
| 5,839,250 A | * | 11/1998 | Hibler | |
| 5,918,426 A | * | 7/1999 | Gifford et al. | |
| 5,918,427 A | * | 7/1999 | VanderWerf | |
| 6,044,601 A | * | 4/2000 | Chmella et al. | |
| 6,131,348 A | * | 10/2000 | Dunham | |

* cited by examiner

*Primary Examiner*—Robert Canfield
(74) *Attorney, Agent, or Firm*—Fleit, Kain; Robert C. Kain, Jr.

(57) ABSTRACT

The L-shaped, end cap is adapted to be mounted on a concrete balcony. The balcony has a rise (a vertical height) an upper run and a lower run. The end cap is an L-shaped end piece having a front plate and a lower plate. The front plate of the end piece has a plate rise substantially equivalent to the concrete balcony rise. The L-shaped end piece has a depending lip along the interface between the plate rise and the lower plate run. The depending lip is adapted to collect and disperse water droplets therefrom. Preferably, the end piece is made of pultruded fiberglass. However, the end piece may be made of plastic, stainless steel, copper, aluminum or other similar materials. For example, pultruded fiberglass may be utilized as the end piece. A method of capping a concrete balcony includes covering the rise and a portion of the lower balcony run by adhering plastic thereon and forming, with the plastic, a depending drip edge.

13 Claims, 4 Drawing Sheets

END CAP FOR CONCRETE BALCONY AND METHOD THEREFOR

This application claims benefit to U.S. provisional patent application Ser. No. 60/170,498, field Dec. 13, 1999.

The present invention relates to an end cap adapted to be mounted on a concrete balcony and a method therefor.

Concrete balconies are found on many high rise buildings. These balconies extend horizontally from an outer vertical wall of the building. Sometimes these balconies are cantilevered. Other balconies are supported by vertical supports. Typically, reinforcing iron or steel rods are suspended in the concrete form prior to pouring concrete into the form. The concrete flows around the reinforcing steel thereby encapsulating the steel in the concrete balcony. When concrete cures, the form is removed and the concrete balcony protrudes horizontally from the vertical building wall. In many situations, a railing system is mounted atop the concrete balcony.

Since the balconies are exposed to outdoor environmental conditions (rain, wind, snow, salt air, etc.), rain and other water drains from the balcony. However, rain and condensation accumulate along the terminal, lower edge of the balcony. The continual effect of this water has a tendency to dissolve the concrete along the terminal lower edge of the concrete balcony. This causes the lower edge to crack, spall, and generally deteriorate. When the building is near a body of salt water, the salt in the air further accelerates the deterioration of the lower terminal edge of the balcony.

There is a need to provide a better water protection and drainage system on concrete balconies for new construction and during the repair and renovation of concrete balconies.

U.S. Pat. No. 1,536,895 to Lindyberg discloses the repair of concrete steps by (a) laying down iron or metal reinforcement rods; (b) providing an end cap as a C-shape with the rod running through to the end face of the end cap; and (c) pouring a large upper and edge layer of concrete.

U.S. Pat. No. 3,243,926 to Keyt discloses a gravel stop for a roof and shows a thin layer cap.

U.S. Pat. No. 5,729,933 to Strength discloses a cornice or facia plate with a downwardly extending drip lip.

The following patent references provide background information for concrete structures: U.S. Pat. No. 5,505,030 to Michalcewiz et al.; U.S. Pat. No. 4,700,512 to Laska; U.S. Pat. No. 4,869,752 to Jaklin; U.S. Pat. No. 4,869,753 to Jaklin; and U.S. Pat. No. 4,780,021 to Bettigole.

OBJECTS OF THE INVENTION

It is an object of the present invention to provide an end cap for a concrete balcony which protects against and disperses water and further protects the balcony against water damage and provides a drainage system.

It is a further object of the present invention to provide an end cap which is substantially impervious to deterioration by water.

It is another object of the present invention to provide an end cap system which can be utilized both for new balcony construction and renovation and repair of existing concrete balconies.

It is another object of the present invention to seal the vertical end face of a balcony with a lower, horizontal edge region of the protruding balcony.

It is a further object of the present invention to provide a method of capping concrete balconies.

SUMMARY OF THE INVENTION

The L-shaped, end cap is adapted to be mounted on a concrete balcony. The balcony has a rise (a vertical height) an upper run and a lower run. The end cap is an L-shaped end piece having a front plate and a lower plate. The front plate of the end piece has a plate rise substantially equivalent to the concrete balcony rise. The L-shaped end piece has a depending lip along the interface between the plate rise and the lower plate run. The depending lip is adapted to collect and disperse water droplets therefrom. Preferably, the end piece is made of pultruded fiberglass. However, the end piece may be made of plastic, stainless steel, copper, aluminum or other similar materials. For example, pultruded fiberglass may be utilized as the end piece. A method of capping a concrete balcony includes covering the rise and a portion of the lower balcony run by adhering plastic thereon and forming, with the plastic, a depending drip edge.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to an end cap to be mounted on a concrete balcony. The horizontal expanse of the balcony may be rectangular, square or have an outer, outboard edge that is curved. The end caps described hereinafter may be curved to complement the outboard edge face of the balcony.

Figure 1:
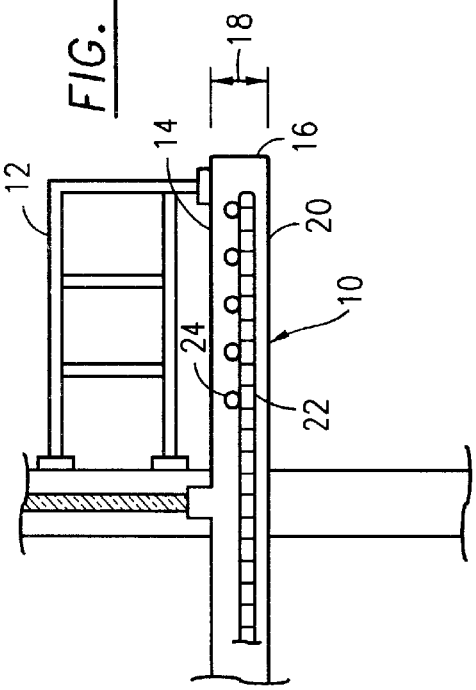
FIG. 1 diagrammatically illustrates a cross-sectional view of a concrete balcony and diagrammatically illustrates embedded steel reinforcing rods in the balcony.

FIG. 1 diagrammatically illustrates concrete balcony 10 having railing system 12 mounted on upper run 14 of balcony 10. Balcony 10 has a rise 16 with a vertical height 18. Balcony 10 also includes a lower run 20. FIG. 1 diagrammatically illustrates steel or iron reinforcing rods 22 and a plurality of laterally disposed reinforcing rods, one of which is reinforcing lateral rod 24. In practice, concrete balcony 10 may include two or more vertically aligned longitudinal reinforcing rods as shown in FIG. 2A.

Figure 2A:
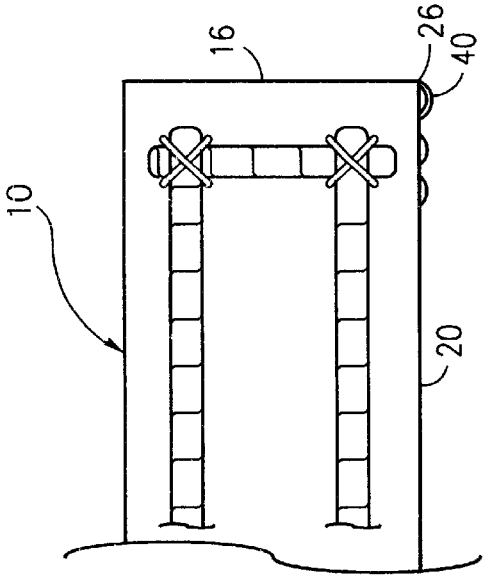
FIG. 2A diagrammatically illustrates the formation of water at the terminal lower edge of the concrete balcony.

FIG. 2A. shows concrete balcony 10 with water droplets 40 forming on the lower terminal edge 26 at the interface between balcony rise 16 and lower balcony run 20. This water is a result of rain or condensation on lower balcony run 20.

Figure 2B:
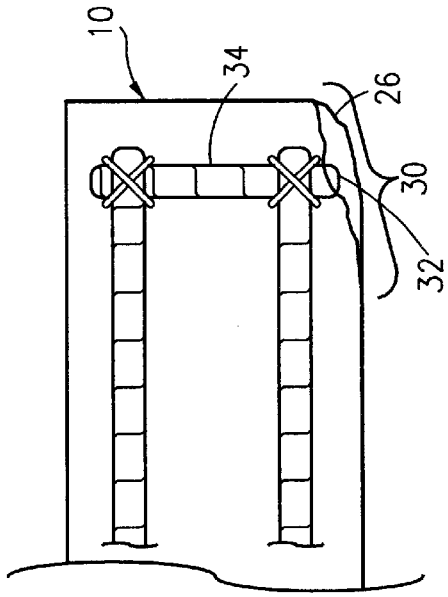
FIG. 2B diagrammatically illustrates deterioration of the lower edge of the balcony.

FIG. 2B shows balcony 10 having concrete spallation or deterioration along lower terminal edge 26. Spallation region 30 in FIG. 2B has extended to a point such that lower edge 32 of vertical reinforcing rod 34 is exposed to the ambient environment. Corrosion of rod 34 increases further deterioration of the balcony due to corrosion and expansion due to oxidation.

Figure 3B:
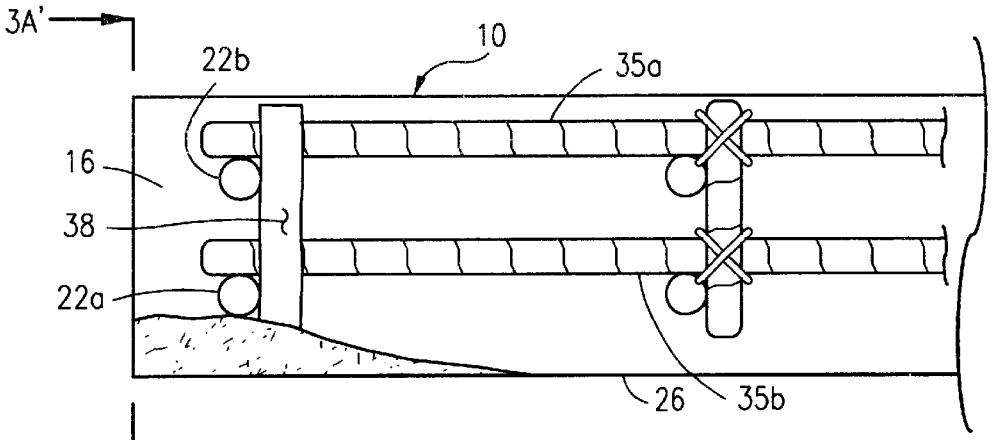
FIG. 3B is a diagrammatic view of the partially repaired concrete balcony from the perspective of section line 3B'–3B" in FIG. 3A (FIG. 3A being a view of the balcony from the perspective of section line 3A'–3A" in FIG. 3B)
Figure 3A:
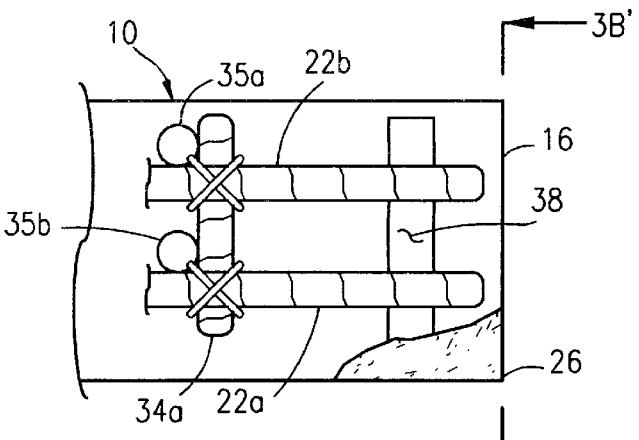
FIG. 3A diagrammatically illustrates a stage of repair wherein the deteriorated portion of the concrete balcony is chipped away and one of the vertical reinforcing rods is removed.

FIGS. 3A and 3B diagrammatically illustrate a side view (FIG. 3A) and a front view (FIG. 3B) of concrete balcony 10 during various stages of balcony repair. In the situation illustrated in FIGS. 3A and 3B, vertical reinforcing rod 34 has been removed by drilling or otherwise creating space or bore hole 38. During the repair, concrete in spallation region 30 is chipped away from lower terminal edge 26 of the balcony. Longitudinal reinforcing rod 22*a* , 22*b*, tied via wires to vertical reinforcing rods 34*a* and to lateral reinforcing rods 35*a*, 35*b*, are illustrated in these figures.

Figure 4:
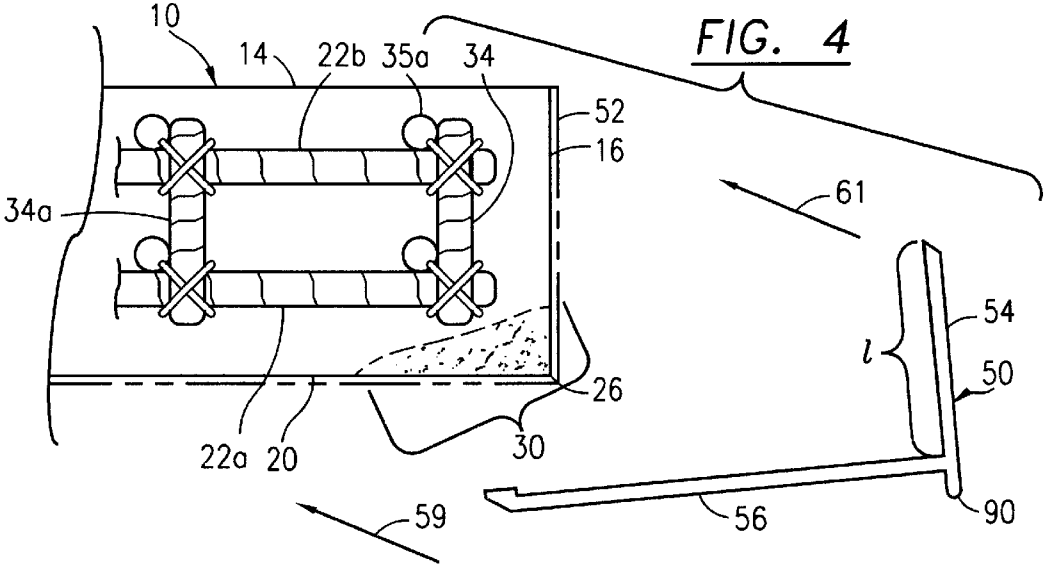
FIG. 4 diagrammatically illustrates the repair of a concrete balcony by applying a one piece, L-shaped end piece to the concrete balcony (an adhesive is used to mount the end piece to the balcony)

FIG. 4 shows concrete balcony 10 wherein spallation has been chipped away from lower terminal edge 26 of balcony 10 in preparation for L-shaped end piece 50. A layer of adhesive 52 is mounted thereon either in sheet form or in liquid form. The adhesive fills spallation region 30. Alternatively, other types of concrete fill material could be utilized to fill spallation region 30. In any event, adhesive layer 52 is placed on balcony rise 16 and a portion of lower balcony run 20.

L-shaped end piece 50 includes a front plate 54 having a length I substantially equivalent to the height of balcony rise 16. End piece 50 includes a lower plate 56 which, in the preferred embodiment, is at least as long (in a direction normal to plate 54) as front plate 54 and rise 1 and preferably is approximately twice as long as the rise of front piece 54. After adhesive 52 is placed on balcony rise 16 and end portion 20 of the lower balcony run, end piece 50 is placed thereon as shown by arrows 59, 61.

The end piece seals the vertical and horizontal underside of the concrete balcony such that water does not penetrate those faces.

End piece 50 is preferably made of pultruded fiberglass. Plastic, reinforced plastic, stainless steel, copper, aluminum and similar materials may be utilized.

Figure 5:
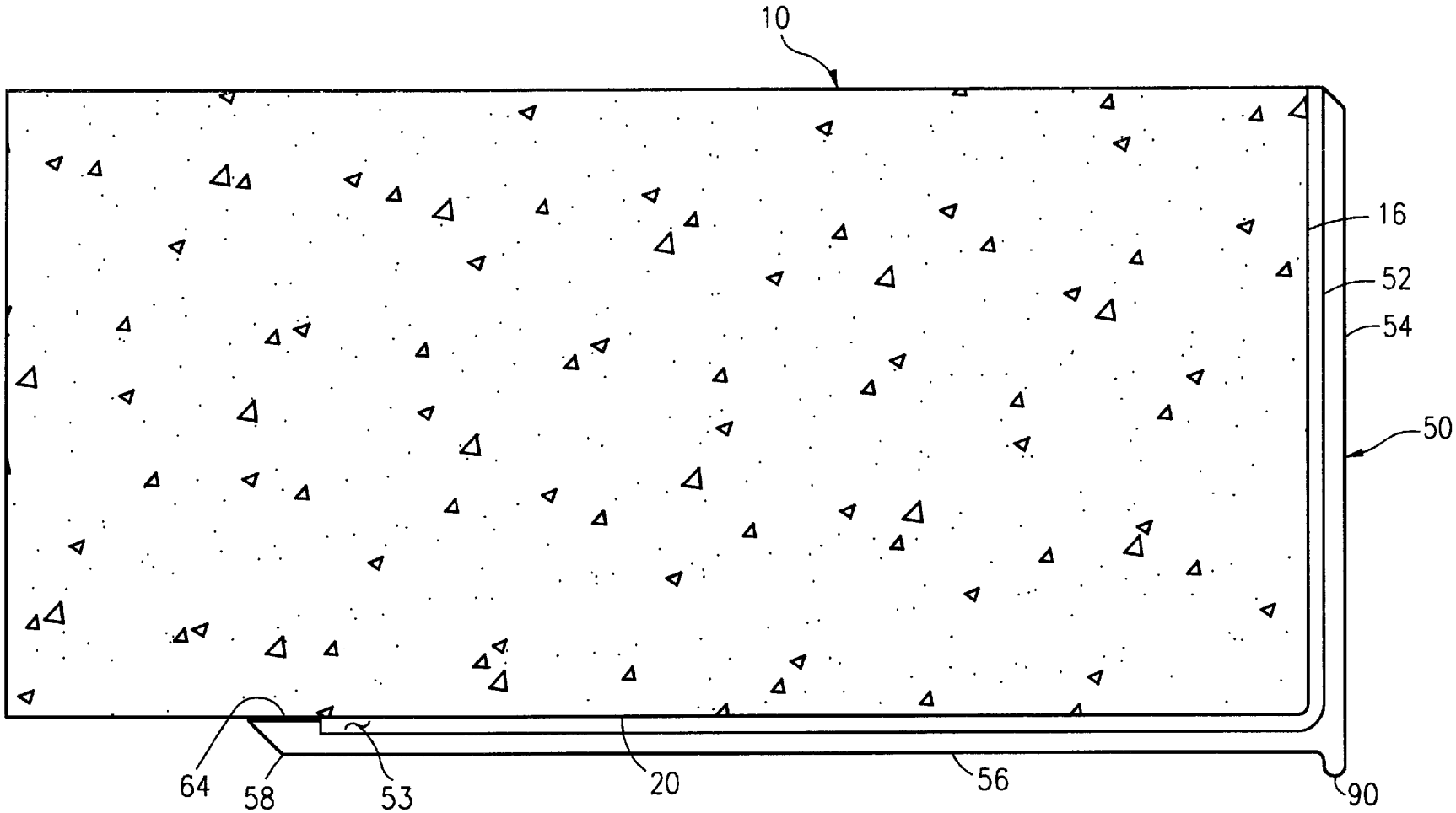
FIG. 5 diagrammatically illustrates the concrete balcony with the end piece mounted thereon.

FIG. 5 shows a one piece end piece 50 mounted on concrete balcony 10. Adhesive 52 is intermediate and forms a sealing barrier between balcony rise 16 and lower balcony run 20. Further, proximal end 58 of lower plate 56 of end piece 50 has an inboard extending lip or ledge 64 which provides an inboard proximal barrier to adhesive region 53. FIG. 5 also illustrates that plastic end piece 50 may be mounted on balcony 10 during the initial construction. Accordingly, the present invention can be utilized in connection with new construction of concrete balconies as well as the renovation and repair of existing concrete balconies. In a preferred embodiment, end piece 50 is not used when reinforcing rods must be removed due to corrosion.

Figure 6:
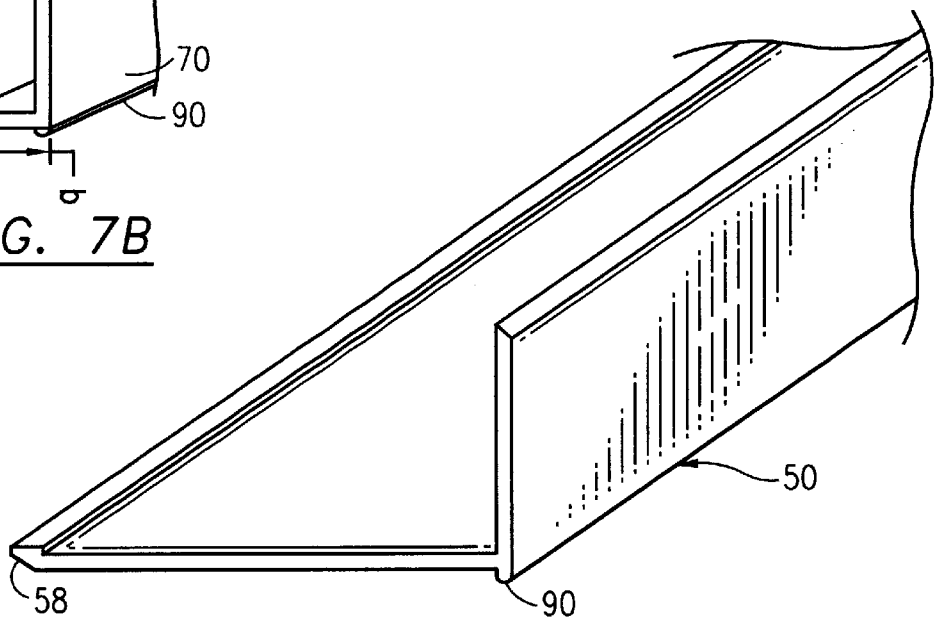
FIG. 6 diagrammatically illustrates a perspective view of the one piece L-shaped end piece.

FIG. 6 shows end piece 50 as a singular, one piece structure.

Figure 7B:
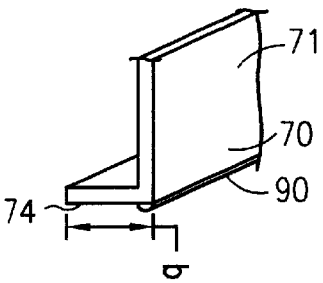
FIGS. 7A and 7B diagrammatically illustrate the end piece formed of two sections (preferably fiberglass and most preferably protruded fiberglass)
Figure 7A:
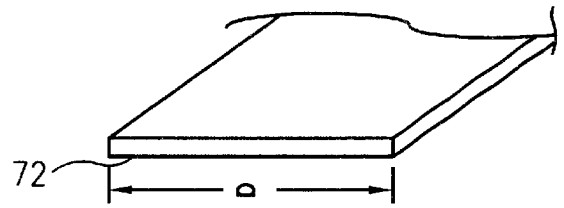

FIG. 7A and FIG. 7B diagrammatically illustrate a two piece end piece 50 consisting of an L-shaped front piece 70 with a front plate 71 and a substantially flat, lower plate 72. Distance a of lower planar plate 72 and distance b of a lower plate segment 74 of first L piece 70 provide coverage over lower balcony run portion 20 (see FIG. 4).

Figure 9:
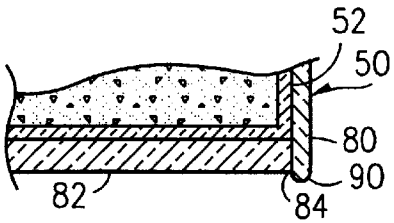
FIG. 9 diagrammatically illustrates the end piece as a two piece construction; and, FIG. 10 diagrammatically illustrates a key and tab locking system for a two piece end piece.

FIG. 9 shows end piece 50 having a planar front plate 80 and a planar lower 82 which are joined by adhesive or other sealing system at interface 84.

Figure 10:
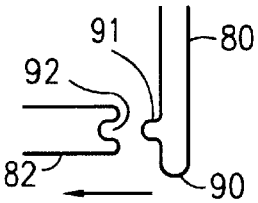

FIG. 10 shows front plate 80 having a tab 91 which fits into lock channel 92 of lower plate 82.

An important feature of the present invention is depending lip 90 on cap piece 50 at the intersection between front plate 54 and lower plate 56. Depending drip lip 90 enhances the collection and subsequent disbursement of water and water droplets from end piece 50 as well as from balcony 10. The collection and disbursement of water droplets significantly reduces, if not eliminates, deterioration of the concrete balcony edge.

End plate 50 may be made of plastic or reinforced plastic. In a current embodiment, pultruded fiberglass is utilized to form end piece 50. Pultruded fiberglass is created by drawing fiberglass fibers through a mold or a dye while the fiber glass fibers are impregnated with fiberglass resin. A reinforced fiberglass or plastic structure is created.

Although a vertical (90° from horizontal) end face 16 is shown on balcony 10, the end cap system described herein can be used on end faces which are (a) sloped inboard from upper run 14 to lower run 20 (from about 190° to about 260° from horizontal); (b) sloped outboard (from 90° to about 170° from horizontal); and (c) concave or convex. The end piece is formed to closely fit the end face 16 whatever its shape.

The method of capping the concrete balcony, if it is new construction, includes placing a layer of adhesive 52 on balcony rise 16, covering the balcony rise 16 with an end piece member, covering a portion of the lower balcony run 20 with adhesive and an end piece member and forming drip edge 90 at the interface between front plate 54 and lower plate 56.

Figure 8:
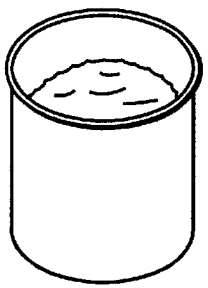
FIG. 8 diagrammatically illustrates adhesive in liquid or semi-liquid form.

Adhesive 52 may be liquid as shown in FIG. 8 or may be sheets of adhesive.

The following provides some dimensional aspect of the present invention:

Exemplary Dimension Table adhesive bonding thickness ⅛ in.
end cap thickness ⅛ in.
end cap run about 10 in.
end cap rise about 6½ in.
nipple ⅜ in.

The claims appended hereto are meant to cover modifications and changes within the scope and spirit of the present invention.

What is claimed:

1. An end cap in combination with a concrete balcony, said concrete balcony having a rise, an upper run and a lower run, the end cap comprising:

an L-shaped end piece having a front plate and a lower plate extending from an edge of said front plate, said front plate having a plate rise substantially equivalent to the concrete balcony rise, said L-shaped end piece having a terminal depending lip along said front plate edge adapted to collect and disburse water droplets therefrom; and said end cap mounted on said concrete balcony along a portion of said rise and said lower run.

2. An end cap combination as claimed in claim 1 wherein said lower plate has a plate run which is at least as long as said plate rise.

3. An end cap combination as claimed in claim 1 wherein said end piece is made of reinforced plastic.

4. An end cap combination as claimed in claim 3 wherein said end piece is made of one of fiberglass and pultruded fiberglass.

5. An end cap combination as claimed in claim 1 wherein said end piece is made of one of fiberglass, plastic, stainless steel, copper and aluminum.

6. An end cap system in combination with a concrete balcony, said concrete balcony having a rise, an upper run and a lower run, the end cap system comprising:

an L-shaped end piece having a front plate and a loer plate extending from an edge of said front plate, said front plate having a plate rise substantially equivalent to the concrete balcony rise, said front plate and said lower plate having respective interior surfaces, said L-shpaed end piece having a terminal depending lip along said front plate edge adapted to collect and disburse water droplets therefrom when said end piece is mounted onto said concrete balcony;

an adhesive adapted to be interposed between said respective interior surfaces of said front and lower plates and the corresponding balcony rise and lower balcony run; and said end cap mounted on said concrete balcony along a portion of said rise and said lower run.

7. An end cap system as claimed in claim 6 wherein said adhesive is provided as one of a sheet, a sheet sized to said front and lower plates, and an L-shaped adhesive pad, and a liquid adhesive.

8. An end cap system as claimed in claim 6 wherein said lower plate has a plate run which is at least as long as said plate rise.

9. An end cap system as claimed in claim 6 wherein said end piece is made of reinforced plastic.

10. An end cap system as claimed in claim 6 wherein said end piece is made of fiberglass.

11. An end cap system as claimed in claim 6 wherein said end piece is made of pultruded fiberglass.

12. A method of capping a concrete balcony having a rise, an upper run and a lower run, the method comprising:

covering said rise and a portion of said lower balcony run by adhering plastic or fiberglass thereon; and forming, with said plastic or fiberglass, a depending drip edge at the intersection of said balcony rise and lower balcony run such that water collects and is disbursed from said drip edge.

13. A method as claimed in claim 12 including the step of providing a preformed L-shaped plastic or fiberglass end piece having a front plate and a lower plate extending from an edge of said front plate, and the method includes the step of placing an adhesive between said front and lower plates and the corresponding balcony rise and lower balcony run.

* * * * *